US006711864B2

(12) United States Patent
Erwin

(10) Patent No.: US 6,711,864 B2
(45) Date of Patent: Mar. 30, 2004

(54) WOOD DECK PLANK WITH PROTECTIVE CLADDING

(75) Inventor: Ronald D. Erwin, Fayetteville, GA (US)

(73) Assignee: Erwin Industries, Inc., Peachtree City, GA (US)

( * ) Notice: Subject to any disclaimer, the term of this patent is extended or adjusted under 35 U.S.C. 154(b) by 0 days.

(21) Appl. No.: 09/943,621

(22) Filed: Aug. 30, 2001

(65) Prior Publication Data

US 2002/0121064 A1 Sep. 5, 2002

Related U.S. Application Data

(60) Provisional application No. 60/273,376, filed on Mar. 5, 2001.

(51) Int. Cl.[7] ..... E04B 2/00
(52) U.S. Cl. ..... 52/582.1; 52/586.2; 52/585.1
(58) Field of Search ..... 52/582.1, 586.2, 52/585.1, 309.15, 313, 480

(56) References Cited

U.S. PATENT DOCUMENTS

| | | | | |
|---|---|---|---|---|
| 1,533,074 A | | 4/1925 | Denning | |
| 1,723,306 A | * | 8/1929 | Sipe | 52/396.04 |
| 1,946,646 A | * | 2/1934 | Storm | 52/393 |
| 2,007,354 A | | 7/1935 | Vass | |
| 2,204,675 A | * | 6/1940 | Grunert | 52/578 |
| 3,445,325 A | * | 5/1969 | Clark | 428/119 |
| 3,680,530 A | | 8/1972 | Drawsky | |
| 4,304,080 A | | 12/1981 | Freeman | |
| 4,526,418 A | | 7/1985 | Martin | |
| 4,555,292 A | * | 11/1985 | Thompson | 156/279 |
| 4,649,588 A | | 3/1987 | Taylor | |
| 4,795,666 A | | 1/1989 | Okada et al. | |
| 4,885,882 A | * | 12/1989 | Forshee | 52/177 |
| 5,056,286 A | | 10/1991 | Bokor | |
| 5,351,915 A | | 10/1994 | Aandalen | |
| 5,412,915 A | | 5/1995 | Johnson | |
| 5,483,773 A | | 1/1996 | Parisien | |
| 5,632,123 A | | 5/1997 | Erwin | |
| 5,642,592 A | | 7/1997 | Andres | |
| 5,653,076 A | | 8/1997 | Habraken et al. | |
| 5,660,016 A | | 8/1997 | Erwin et al. | |
| 5,713,165 A | | 2/1998 | Erwin | |
| 5,755,068 A | * | 5/1998 | Ormiston | 52/314 |
| 5,896,723 A | * | 4/1999 | Sing | 52/730.7 |
| 6,237,295 B1 | | 5/2001 | Ballard | |
| 6,453,630 B1 | * | 9/2002 | Buhrts et al. | 52/177 |
| 6,468,643 B1 | * | 10/2002 | Kanbayashi et al. | 428/293.7 |
| 6,484,467 B2 | * | 11/2002 | Crout | 52/483.1 |

FOREIGN PATENT DOCUMENTS

| | | | |
|---|---|---|---|
| AT | 200135041 A | * | 4/2001 |
| JP | 406322950 A | * | 11/1994 |

OTHER PUBLICATIONS

Brite Millwork, Inc., Ontario Canada, Life Long Composite Wood Decking, 2 pages, www.britemillwork.com.

* cited by examiner

*Primary Examiner*—Carl D. Friedman
*Assistant Examiner*—Naoko Slack
(74) *Attorney, Agent, or Firm*—Gardner Groff, P.C.

(57) ABSTRACT

A plank having a wood core with a groove formed in each of its sides and a protective cladding formed on its top surface. The wood core is formed by bonding a plurality of wood strips or chips together. The cladding is provided by a sheet of a material selected from the group consisting of plastic, polyvinyl chloride (PVC), acrylic, polycarbonate, and composites thereof that is bonded to the top surface, or by two or another number of sheets of a material selected from the group consisting of polyester, phenol, epoxy, and composites thereof, that are sprayed or rolled onto the top surface. T-shaped connector clips can be provided with the arms receivable in the grooves of the plank for securing adjacent planks together.

16 Claims, 2 Drawing Sheets

WOOD DECK PLANK WITH PROTECTIVE CLADDING

CROSS REFERENCE TO RELATED APPLICATION

This application claims the priority benefit of U.S. Provisional Patent Application No. 60/273,376 filed on Mar. 5, 2001, which is hereby incorporated by reference in its entirety.

TECHNICAL FIELD

The present invention relates generally to planks for decks and, more specifically, to a plank with a protective cladding and connector clips.

BACKGROUND OF THE INVENTION

Outdoor decks are extremely popular in residential home construction. Homes and apartments, as well as a variety of other buildings, often incorporate exterior decks into their design. These decks provide convenient spaces for a variety of outdoor activities, including cookouts, dining and sunbathing, as well as other leisure activities. Moreover, decks typically are provided with a railing or perimeter fence to keep people from falling over the edge of the deck. Additionally, perimeter and accent fencing is commonly added onto landscapes, creating a boundary for foliage displays and garden areas.

Wood products traditionally have been the primary source of materials for use in decking and fence construction. However, wood products are becoming increasingly scarce due to the harvesting of trees at ever faster rates and the rather limited rate at which timber resources can be replenished. Also, environmental concerns and regulations directed to conservation or preservation of forests tend to restrict the availability of wood products. With the diminishing availability of timber resources, wood products are becoming increasingly expensive. There is, therefore, a substantial need for long-lasting substitute construction materials that can lessen the need to harvest timber resources.

One potential approach to addressing the above need is to provide substitute fence and decking products made of plastic, rather than wood. Such plastic products provide a long-lasting alternative to wood. In addition, plastic fence and deck products alleviate the need for costly painting and repainting. A variety of plastic building products are known. For example, U.S. Pat. No. 4,045,603 describes a three-layer synthetic construction material made from recycled waste thermoplastic synthetic resin material and cellulose fiber aggregate. This material includes face surfaces consisting essentially of re-hardened fused and rolled thermoplastic synthetic resin material bits, and an intervening core material consisting essentially of a compressed non-homogenous mixture of cellulose aggregate material bits and re-hardened fused thermoplastic synthetic resin material bits. Such plastic materials have been used to create decking and fencing elements, but have not proven entirely satisfactory.

Accordingly, a need yet remains in the art for decking system that can be quickly and easily installed, and that is made from a plentiful, light-weight, weather-resistant material. It is to the provision of such a fence system that the present invention is primarily directed.

SUMMARY OF THE INVENTION

Generally described, in a first preferred form the present invention provides a wood deck plank with a protective cladding. The plank comprises a wood core having a top surface and two sides, with a groove formed in each of the sides, and a cladding formed onto the top surface, with the cladding selected to provide weather protection and durability. In a preferred form, the wood core is laminated from a plurality of wood strips bonded together. In an alternative form, the wood core is provided by a plurality of wood chips bonded together. In either case, the wood core includes residual wood components instead of solid pieces of lumber.

In the preferred form, the cladding is provided by a sheet of a material such as a plastic, polyvinyl chloride (PVC), acrylic, polycarbonate, or composite thereof, that is bonded to the top surface. In the alternative form, the cladding is provided by two or another number of sheets of a material such as a polyester, phenol, epoxy, and composite thereof, that are sprayed or rolled onto the top surface. The cladding has an exposed surface that is textured by an impression technique, and the cladding is sufficiently thick so that the top surface remains substantially covered and protected by the cladding after the cladding is impressioned. The grooves have a rectangular shape and receive an arm of a T-shaped connector clip, for assembling the planks together and mounting them to a deck frame structure without putting holes in the planks.

Furthermore, there is provided a method of manufacturing the plank, which includes the steps of providing a wood core, forming a groove in each side of the wood core, applying a cladding onto the top surface of the wood core, where the cladding is selected to provide weather protection and durability, impressing a texture onto the exposed surface of the cladding, and providing connector clips receivable in the grooves for connecting adjacent planks together in the construction of a deck.

These objects, advantages and features of the present invention will become more apparent upon reading the following specification in conjunction with the accompanying drawing figures.

BRIEF DESCRIPTION OF THE DRAWING FIGURES

The present invention will be better understood by reading the Detailed Description of the Preferred Embodiment with reference to the accompanying drawing figures, in which.

DETAILED DESCRIPTION OF THE PREFERRED EMBODIMENTS

In describing the preferred and alternate embodiments of the present invention, specific terminology is employed for the sake of clarity. The invention, however, is not intended to be limited to the specific terminology so selected.

Figure 1:
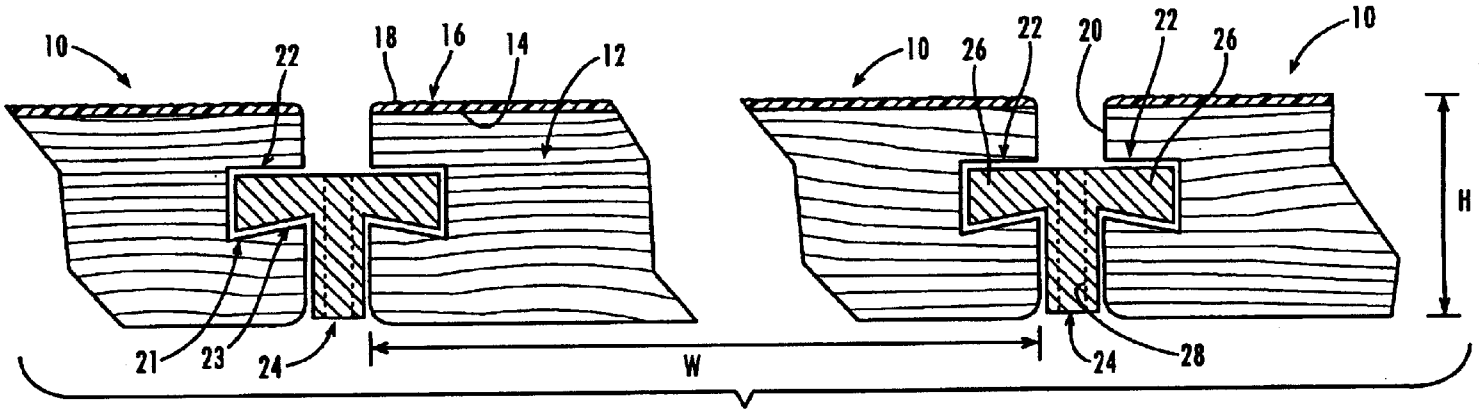
FIG. 1 is a cross-sectional view of the plank according to the present invention, showing a multi-ply core, a top cladding, side profiles, and connector clips.

Referring now in detail to the drawing figures, wherein like reference numerals represent like parts throughout the several views, FIG. 1 shows a plank 10 according to a preferred form of the invention. The plank 10 as depicted has a generally rectangular cross sectional shape and can be provided in various sizes. For example, the plank 10 can have a height H of between ¾ inches and 2 inches, a width W of a few inches or more, and a length of several feet.

The plank 20 has a wood core 12 that is laminated from a plurality of wood strips 14 bonded together by an adherent such as an epoxy suitable for subsequent pressure treating. In the preferred form, the strips 12 are each about ⅛ inch thick and arranged with parallel grain plies to minimize warping and cupping. The particular wood used can selected based on the desired strength, durability, cost, and other factors. Also, the wood core 12 can be pressure-treated with borates or other non-hazardous substances, and dried in a kiln or other device to the proper moisture, as may be desired.

The wood core 12 has a wear surface 14 (typically the top or exposed surface) that is coated with a cladding 16 for weather protection and durability. The cladding 16 is provided by a sheet of a material such as a plastic, polyvinyl chloride (PVC), acrylic, polycarbonate, composite thereof, or another material selected for weather protection and durability, that is bonded to the wear surface 14. Alternatively, the cladding 16 can be provided by two or another number of sheets of a material such as a polyester, phenol, epoxy, composite thereof, or another material selected for weather protection and durability, that is sprayed or rolled onto the wear surface 14.

The exposed surface 18 of the cadding 16 has a texture provided by embossing, stamping, or another technique. The surface texture 18 is selected to provide a natural wood grain appearance, and traction to prevent slips and falls by persons walking on a deck built from the planks. In order to create the textured surface 18 by an impression technique such as stamping, the cladding 16 must be sufficiently thick so that the wear surface 14 remains entirely (or at least substantially) covered and protected by the cladding 16 after the cladding 16 is impressioned.

Each side 20 of the plank 10 has a groove 22 defined therein for receiving a connector clip 24 for connecting the planks together onto a floor joist or other decking structure. The groove 22 can have a generally rectangular shape with at least one sidewall that is tapered. For example, each groove 22 can have an enlarged head space 21 within the plank and a narrower neck space 23 adjacent the plank side 20, or another regular or irregular shape.

Figure 2:
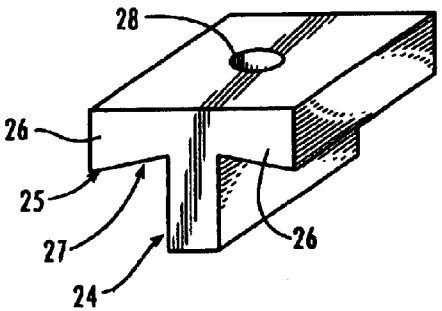
FIG. 2 is a perspective view of one of the clips of FIG. 1.

Referring further to FIG. 2, the clip 24 is generally T-shaped with two arms 26 that are shaped and sized to conform to and fit within the grooves 22 of adjacent planks when connecting the planks together to construct a deck. For example, each arm 26 can have an enlarged head 25 and a narrower neck 27. The clips 24 can be extruded, molded, or made by another fabrication technique, from PVC, acrylic, polycarbonate, or another material. Each clip 24 has an aperture 28 defined therethrough for receiving a screw or another fastener, for connecting the clip 24 to a frame member upon which the deck is being constructed. Details of the construction and use of similar decking clips are provided by U.S. Pat. No. 5,660,016 to Errwin et al., which hereby incorporated by reference in its entirety.

The combination of the wood core 12, the cladding 16, and the side groove 22 and associated clips 24 provide several advantages over the prior art. The wood core 12 provides the high strength of real wood, the cladding 16 protects the otherwise exposed top surface 14 of the wood core 12 from deterioration such as by rotting, the textured surface 18 of the cladding 16 provides a natural wood appearance, and the side groove 22 and T-shaped clip 24 provide for assembling the planks to form a deck without sacrificing the integrity of the planks by creating nail or screw holes therein. Also, if the wood core shrinks over time, then the grooves will shrink onto the clips so that the clip connections will become tighter and more secure, ensuring a solid, lifetime fit.

Figure 3:
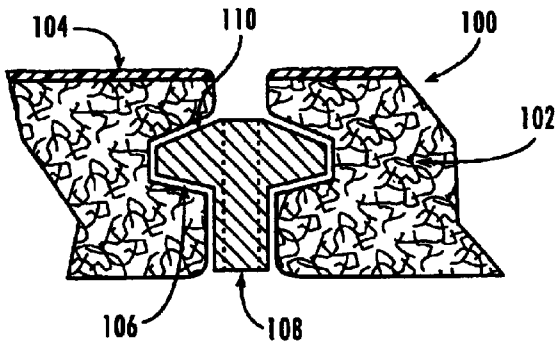
FIG. 3 is an alternative plank and clip according to the present invention.

Referring to FIG. 3, there is shown an alternative form of the present invention, referred to generally as the plank 100. The alternative plank 100 is similar to the preferred plank 10, in that the plank 100 has a wood core 102, a top surface cladding 104, and side grooves 106. However, in this form, the wood core 102 is made from a plurality of pretreated wood chips that are bonded together with an adhesive such as a phenol. Also, the grooves 106 each have two tapered sidewalls to provide a route for moisture to seep downwardly therethrough and out of the plank, so that there is provided no place that will allow for an accumulation of standing moisture that could rot the wood core 102. Accordingly, a clip 108 is provided that is similar to the clip 24, except with arms shaped and sized to conform to the groove 106.

Figure 4:
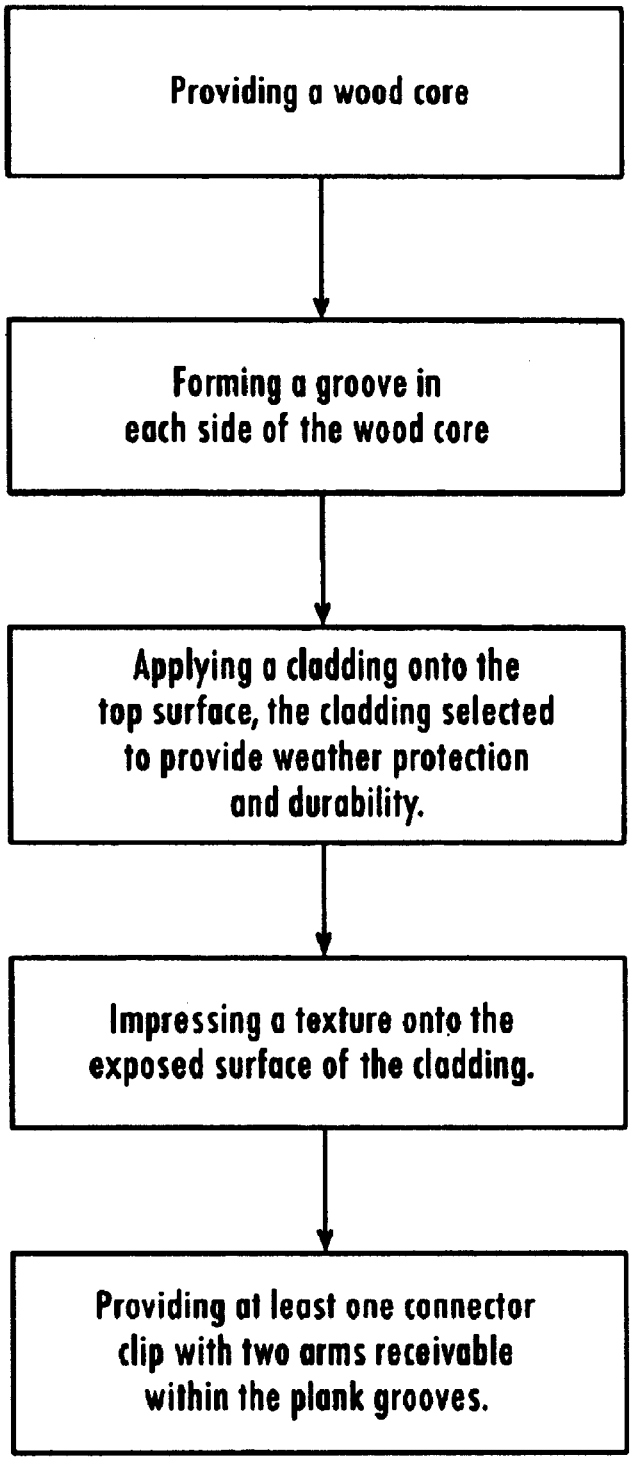
FIG. 4 is a flow diagram describing a method for manufacturing the plank of FIG. 1.

Referring to FIG. 4, there is additionally provided a method of manufacturing the plank. The method comprises providing a wood core having a top surface and two sides; forming an groove formed in each of the sides; and applying a cladding onto the top surface, where the cladding is selected to provide weather protection and durability. The step of providing a wood core can include bonding a plurality of wood strips together or bonding a plurality of wood chips together. The cladding can be provided by a sheet of a material such as a plastic, polyvinyl chloride (PVC), acrylic, polycarbonate, or a composite thereof that is bonded to the top surface, or by two or another number of sheets of a material such as a polyester, phenol, epoxy, or a composite thereof, that are sprayed or rolled onto the top surface. Additionally, the step of applying a cladding onto the top surface can include impressing a texture onto the exposed cladding surface. Furthermore, the step of forming a groove in each of the side can include cutting a rectangular-shaped groove with at least one sidewall that is tapered. The method can also include providing at least one and preferably a plurality of connector clips each having a T-shape with two arms, wherein each arm is receivable within one of the grooves of the plank.

Having thus described the preferred forms of the present invention, those skilled in the art will additionally recognize that the within disclosures are exemplary only, and that various other alternatives, adaptations, and modifications may be made within the spirit and scope of the present invention as set forth in the following claims.

What is claimed is:

1. A decking system, comprising:

at least two planks each having two sides, with a groove formed in each of the sides, each of the grooves having a half-dovetailed shape defined by a head space and a neck space that is narrower that the head space; and at least one connector clip having a T-shape with two arms, wherein each arm has a half-dovetailed shape defined by a head and a neck, wherein each one of the clip arm heads is receivable within one of the groove head spaces of the plank but is not extendable through the corresponding groove neck space so that if the wood core shrinks then the grooves will contract into a tighter fit on the arms.

2. The decking system of claim 1, wherein each of the planks comprises a wood core with a top surface and a cladding formed on the top surface only, the cladding selected to provide weather protection and durability.

3. The decking system of claim 2, wherein the wood core is laminated from a plurality of wood strips bonded together.

4. The decking system of claim 2, wherein the wood core is provided by a plurality of wood chips bonded together.

5. The decking system of claim 2, wherein the cladding is provided by a sheet of a material selected from the group consisting of plastic, polyvinyl chloride (PVC), acrylic, polycarbonate, and composites thereof that is bonded to the top surface.

6. The decking system of claim 2, wherein the cladding is provided by two or another number of sheets of a material selected from the group consisting of polyester, phenol, epoxy, and composites thereof, that are sprayed or rolled onto the top surface.

7. The decking system of claim 2, wherein the cladding has an exposed surface that is textured by an impression technique, and the cladding is sufficiently thick so that the top surface remains substantially covered and protected by the cladding after the cladding is impressioned.

8. The decking system of claim 1, wherein the grooves have a generally rectangular shape with at least one sidewall that is tapered.

9. A method of manufacturing a decking system, comprising:

providing at least two wood cores each having a top surface and two sides, forming a groove with a half-dovetailed shape defined by an enlarged head space and a narrower neck space in each of the sides of the wood cores;

applying a cladding onto the top surface only of the wood cores, the cladding selected to provide weather protection and durability; and providing at least one connector clip having a T-shape with two arms, wherein each arm has a half-dovetailed shape defined by a head and a neck, wherein each one of the clip arm heads is receivable within one of the groove head spaces of the plank but is not extendable through the corresponding groove neck space so that if the wood core shrinks then the grooves will contract into a tighter fit on the arms.

10. The method of claim 9, wherein the step of providing a wood core comprises bonding a plurality of wood strips together.

11. The method of claim 9, wherein the step of providing a wood core comprises bonding a plurality of wood chips together.

12. The method of claim 9, wherein the step of applying a cladding comprises bonding to the top surface a sheet of a material selected from the group consisting of plastic, polyvinyl chloride (PVC), acrylic, polycarbonate, and composites thereof.

13. The method of claim 9, wherein the step of applying a cladding comprises spraying or rolling onto the top surface two or another number of sheets of a material selected from the group consisting of polyester, phenol, epoxy, and composites thereof.

14. The method of claim 9, wherein step of applying a cladding onto the top surface further comprises impressing a texture onto the exposed surface thereof.

15. The method of claim 9, wherein the step of forming a groove in each of the side comprises cutting a generally rectangular shaped groove with at least one sidewall that is tapered.

16. A decking system for installing on at least one frame member, comprising:

at least two planks each comprising a wood core having a top surface and two sides, with each of the sides having an upper side portion, a lower side portion, and a groove formed therein between the upper side portion and the lower side portion, the upper side portion and the lower side portion being vertical and coplanar, each of the grooves having a generally rectangular shape with a lower sidewall that is tapered inward and downward to form a head space and a neck space that is narrower that the head space, and a cladding formed on and adhered to the top surface only, the cladding selected to provide weather protection and durability; and at least one T-shaped connector clip having a vertical base and two arms extending from the base, wherein each arm has a generally rectangular shape with a lower sidewall that is tapered outward and downward to form a head and a neck that is narrower that the head, wherein each one of the clip arm heads is receivable within one of the groove head spaces of the plank but is not extendable through the corresponding groove neck space so that if the wood core shrinks then the grooves will contract into a tighter fit on the arms, wherein the clip base has an aperture defined therethrough for receiving a fastener for connecting the clip to the frame member, and wherein the clip base is recessed below the cladding and the vertical sides allow the aperture to be accessed from above the plank to install the fastener and permit the clip base to space the planks apart for drainage.

* * * * *